United States Patent [19]

Berger

[11] 4,291,711

[45] Sep. 29, 1981

[54] TOBACCO SMOKE FILTER PROVIDING TOBACCO FLAVOR ENRICHMENT, AND METHOD FOR PRODUCING SAME

[75] Inventor: Richard M. Berger, Midlothian, Va.

[73] Assignee: American Filtrona Corporation, Richmond, Va.

[21] Appl. No.: 24,251

[22] Filed: Mar. 27, 1979

[51] Int. Cl.[3] ..... A24D 3/02; A24D 3/06

[52] U.S. Cl. ..... 131/336; 131/340; 131/341; 493/47

[58] Field of Search ..... 131/140 C, 144, 10 R, 131/10 A, 174–174 E, 10.5, 10.7, 10.9, 261 A, 261 B, 264–268; 93/1 C, 778 T

[56] References Cited

U.S. PATENT DOCUMENTS

| | | | |
|---|---|---|---|
| 2,948,282 | 8/1960 | White | 131/10 R |
| 3,288,145 | 11/1966 | Rosenthal | 131/10.5 |
| 3,353,543 | 11/1967 | Berger | 131/265 |
| 3,368,566 | 2/1978 | Avedikian | 131/265 |
| 3,477,440 | 11/1969 | Licis | 131/17 A |
| 3,804,695 | 4/1974 | Randall et al. | 131/268 |
| 3,858,587 | 1/1975 | Cavelli et al. | 131/10 A |
| 4,034,765 | 7/1977 | Van Hall | 131/10 A |
| 4,037,524 | 7/1977 | Hall | 131/10.5 |
| 4,091,821 | 5/1978 | Scorzo | 131/10 R |
| 4,174,719 | 11/1979 | Martin et al. | 131/10 A |

FOREIGN PATENT DOCUMENTS

| | | | |
|---|---|---|---|
| 1203172 | 10/1965 | Fed. Rep. of Germany | 131/10 R |
| 760772 | 11/1956 | United Kingdom | 131/10.5 |

*Primary Examiner*—V. Millin

*Attorney, Agent, or Firm*—Holman & Stern

[57] ABSTRACT

A tobacco smoke filter is disclosed, which provides tobacco flavor enrichment of smoke passing therethrough. The filter comprises a reconstituted tobacco member formed from a coherent sheet of reconstituted tobacco which has been uniformly embossed with a series of parallel grooves, and then compacted and bonded into a self-sustaining dimensionally stable axially elongated body whose longitudinal axis extends parallel to the embossed grooves. The embossed grooves provide the reconstituted tobacco member with flow passages having a high surface area for contact with smoke passing therethrough, so as to enable the smoke to become tobacco flavor-enriched by extracing tobacco flavor from the reconstituted tobacco. The filter may also include an axially elongated fibrous filtering material member disposed concentrically with respect to the reconstituted tobacco member and having a draw resistance greater than that of the reconstituted tobacco member, whereby smoke passing through the filter will be directed primarily through the reconstituted tobacco member.

14 Claims, 10 Drawing Figures

TOBACCO SMOKE FILTER PROVIDING TOBACCO FLAVOR ENRICHMENT, AND METHOD FOR PRODUCING SAME

BACKGROUND OF THE INVENTION

This invention relates to the production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

In making filters for use in connection with cigarettes and the like, a number of different properties of the resultant filter must be taken into consideration. While filtration efficiency, i.e., the ability of the filter to remove undesirable constituents from tobacco smoke, is perhaps the most important property of cigarette filters, filtration efficiency must frequently be compromised in order for the filter to possess a commercially acceptable combination of other properties, including pressure drop, taste, hardness, appearance and cost. For example, the most commonly utilized cellulose acetate filter has a relatively low filtration efficiency since increased efficiency can only be obtained either by increasing the density of the filter material or the length of the filter element, both of which produce a pressure drop across the filter which is excessive and unacceptable from a commercial standpoint.

In recent years, air dilution has become a popular technique for compensating for the relatively low filtration efficiency of cigarette filters having a sufficiently low pressure drop for commercial acceptance. The air dilution technique employs ventilating air to dilute the smoke stream from the cigarette and thereby reduce the quantity of tar and other undesirable tobacco smoke constituents drawn into the smoker's mouth for each puff or draw. The ventilating air is generally provided through a plurality of perforations in the tipping paper employed for joining the filter to the tobacco column of the cigarette, and if the filter is overwrapped with plugwrap paper, an air pervious plugwrap paper is employed.

The air dilution technique has several advantages in that it is the most economical method of reducing tar, it enables achievement of the exact amount of tar delivery desired, and it also enables removal of undesirable gas phase constituents, such as CO and NO. The major disadvantage of the air dilution technique, however, is the loss of taste, particularly when employed with low tar cigarettes containing 10 mgs or less of tar. While satisfactory improvement of the taste can, in some cases, be achieved by flavor enrichment of the cigarette tobacco, such flavor enrichment technique has been found to be relatively ineffective for producing commercially acceptable taste at tar levels below 5 mgs.

Since tobacco itself is known to be effective for filtering tobacco smoke, various filter instructions have previously been proposed in which tobacco is employed as at least a portion of the filtering material for the purpose of improving the taste properties of the filtered smoke. Such previously proposed filter constructions have employed the tobacco either in the form of fine particles or granules dispersed within a bonded matrix of the primary filtering material, as described, for example, in U.S. Pat. Nos. 2,948,282 and 3,353,543; or in the form of a separate short column of loose shredded tobacco similar to the main cigarette tobacco column and generally separated therefrom either by means of an ignition suppression disk, as described, for example, in U.S. Pat. Nos. 3,288,145 and 4,091,821, or by means of other filtering materials, as described, for example, in U.S. Pat. No. 3,858,587. For the most part, however, these constructions have proven to be too cumbersome and/or costly for large-scale production, or relatively ineffective for producing commercially acceptable taste at very low tar levels, particularly when coupled with air dilution means.

SUMMARY OF THE INVENTION

It is, accordingly, a primary object of the present invention to provide a tobacco smoke filter which, when coupled with air dilution means, is effective for producing commercially acceptable taste at low tar levels.

Another object of the invention is to provide a tobacco smoke filter in accordance with the preceding object, which includes tobacco as at least a portion of the filtering material for tobacco flavor enrichment of the filtered smoke, and which is of a construction which is relatively simple and economical to produce in a large scale.

A further object of the invention is to provide a tobacco smoke filter in accordance with the preceding object, which has a dual filter material construction which enables smoke passing therethrough to be directed primarily through the tobacco portion thereof for optimum tobacco flavor enrichment of the smoke.

Still another object of the invention is to provide a relatively simple and economical method for the continuous large-scale production of tobacco smoke filters in accordance with the preceding objects.

The above and other objects are achieved in accordance with the present invention by providing a tobacco smoke filter element comprising a reconstituted tobacco member formed from a coherent sheet of reconstituted tobacco which has been uniformly embossed with a series of parallel grooves. The embossed reconstituted tobacco sheet is formed or compacted together and then bonded together into a self-sustaining dimensionally stable axially elongated body whose longitudinal axis extends parallel to the embossed groove. The embossed grooves provide the reconstituted tobacco member with flow passages having a high surface area for contact with smoke passing therethrough so as to enable the smoke to become tobacco flavor-enriched by extracting tobacco flavor from the reconstituted tobacco.

In the preferred embodiments of the tobacco smoke filter element in accordance with the present invention, an axially elongated member of fibrous filtering material, such as cellulose acetate tow, is disposed concentrically with respect to the reconstituted tobacco member. In such dual filtering material construction, one of the axially elongated members is in the form of a rod-like core, circumferentially enveloped by the other axially elongated member which is hollow and annular-shaped. While the reconstituted tobacco member may constitute either one of these two concentric portions of the filter element, it preferably takes the form of the rod-like core portion. In either case, the fibrous filtering material member has a draw resistance greater than that of the reconstituted tobacco member, whereby smoke passing through the filter element will be directed primarily through the reconstituted tobacco member so as to optimize the tobacco flavor enrichment of the smoke.

The tobacco smoke filter elements in accordance with the present invention may be readily and easily manufactured by a continuous automated process in which the reconstituted tobacco member is produced from a continuous web of the coherent reconstituted tobacco sheet. Such web is first uniformly embossed with a series of parallel longitudinally extending grooves, and the embossed web is then compacted together into an axially elongated formation whose longitudinal axis extends parallel to the embossed grooves. The compacted embossed web is thereafter passed through a heated confined area, and steam or other heated gas is introduced into the compacted embossed web during its passage through the confined area, thereby bonding the compacted embossed web into a self-sustaining axially elongated reconstituted tobacco body, which is then preferably cooled to essentially room temperature. The resulting self-sustaining dimensionally stable axially elongated reconstituted tobacco body constitutes at least a concentric portion of a filter rod, which is finally transversely cut into segments of suitable length for use as filter elements.

In carrying out the above-described continuous automated process for manufacturing the dual filtering material filter elements in accordance with the present invention, the fibrous filtering material member is produced from a bondable continuous filamentary tow of fibrous filtering material, and as cellulose acetate tow. In the preferred embodiment, after first producing a rod-like reconstituted tobacco body in the manner described above, the filamentary tow of fibrous filtering material is fed in an annular-like axially elongated formation into circumferential juxtaposition to the reconstituted tobacco body, the reconstituted tobacco body together with the axially elongated formation of fibrous filtering material is passed through a heated confined area, and steam or other heated gas is introduced into the fibrous filtering material during its passage through the confined area, thereby bonding the fibrous filtering material into a self-sustaining dimensionally stable hollow annular-shaped axially elongated body circumferentially enveloping the reconstituted tobacco body. In an alternative embodiment, the procedure is essentially reversed, i.e., a rod-like fibrous filtering material body is first produced, and a hollow annular-shaped reconstituted tobacco body circumferentially enveloping the rod-like fibrous filtering material body is thereafter produced in the manner described above. In either case, the resulting dual filtering material filter rod is then preferably cooled to essentially room temperature, and thereafter transversely cut into segments of suitable length for use as filter elements.

The tobacco smoke filter elements produced in accordance with the present invention are particularly suitable for use in conjunction with conventional air dilution means for providing filtered tobacco smoke of commercially acceptable taste, even at very low tar levels. When the filter element is utilized in this manner, its construction enables the mixture of smoke and ventilation air passing therethrough to contact a high surface area of the reconstituted tobacco so that such mixture while being filtered also extracts a substantial amount of tobacco flavor from the reconstituted tobacco and thereby becomes significantly enriched in tobacco flavor. The filter elements of the present invention when coupled with air dilution have also been found to increase the CO removal over that normally obtainable with conventional air dilution, and thereby effect a corresponding increase in the tar/CO ratio for a given amount of tar delivery in the filtered smoke. Moreover, since the reconstituted tobacco sheet employed in producing the filter elements in accordance with the present invention is made from tobacco wastes, such filter elements are relatively economical to produce.

BRIEF DESCRIPTION OF THE DRAWINGS

Other features and advantages of the present invention will be better understood from the following detailed description of preferred embodiments thereof, in conjunction with the accompanying drawings, in which.

DESCRIPTION OF PREFERRED EMBODIMENTS

Figure 1:
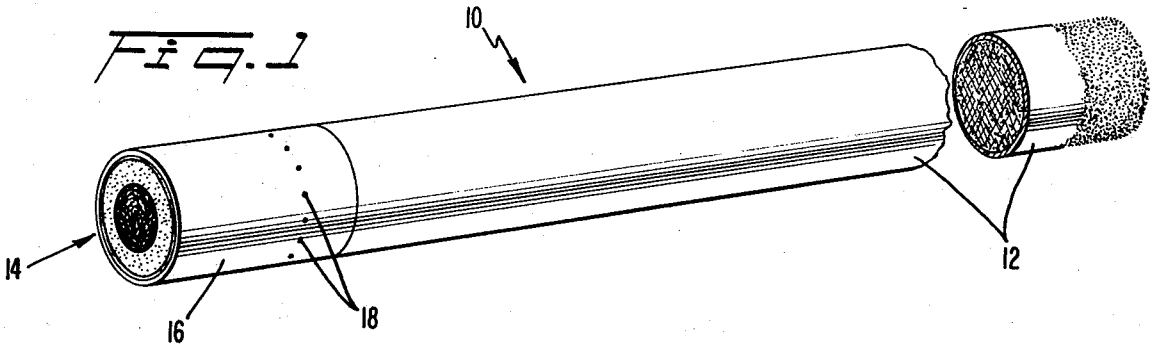
FIG. 1 is an enlarged perspective view of a cigarette having one form of filter produced according to the invention.
Figure 2:
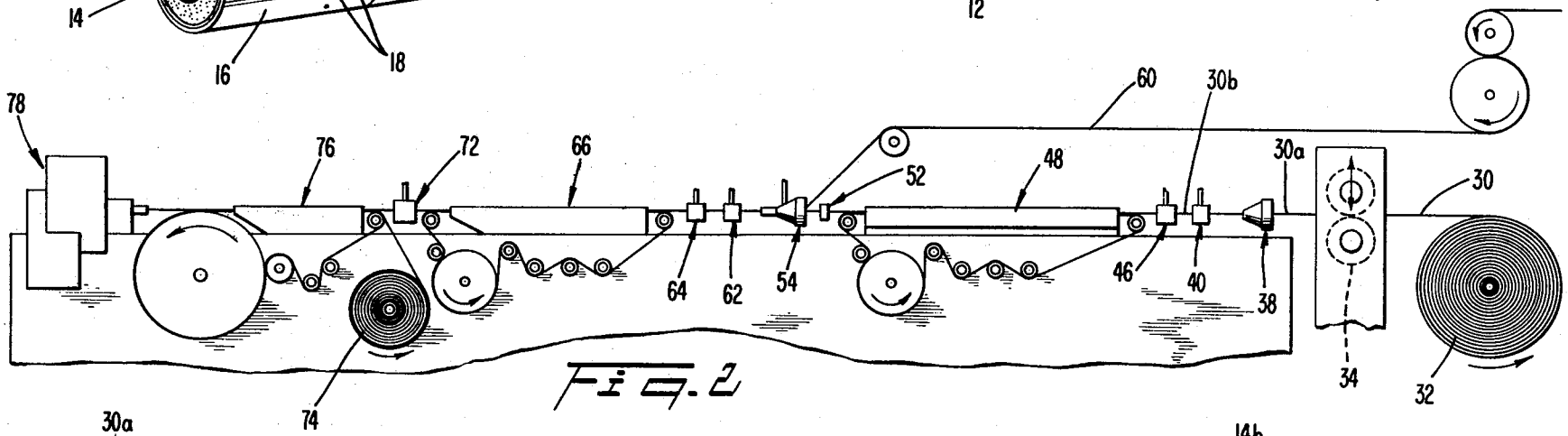
FIG. 2 is a schematic view of a method and production-line assembly of stations for the continuous automated production of one form of filter elements according to the present inventive concepts.

Referring now to the drawings, and more particularly to FIG. 1, a filtered cigarette according to the present inventive concepts is designated generally by the reference numeral 10 and comprises basically a cigarette tobacco column 12 and a filter element according to one embodiment of this invention, designated generally by the reference numeral 14. The tobacco column 12 and the filter element 14 are secured in end-to-end relationship according to well know prior art techniques by means of a hollow cylinder or outer wrap of conventional tipping paper 16 provided with a plurality of air dilution perforations 18 arranged circumferentially around the filter element 14 so as to permit ventilating air to be drawn through the filter element with each draw or puff of the cigarette.

Figure 4:
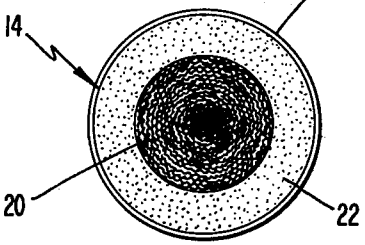
FIG. 4 is an enlarged end elevational view of the filter element of the filtered cigarette of FIG. 1.

The filter element 14 is composed of three concentrically arranged axially elongated members which are co-extensive in length. As best seen in FIG. 4, the filter element 14 comprises an axially elongated rod-like core member 20, which is circumferentially enveloped by an axially elongated hollow annular-shaped intermediate member 22, which, in turn, is circumferentially enveloped by an axially elongated outer overwrap member 24 consisting of a hollow cylinder of conventional air pervious plugwrap paper. Each of the three concentric axially elongated members 20, 22 and 24 is of constant cross-sectional area throughout its length and is in tight frictonal engagement with the member or members contiguous thereto so as to at least substantially preclude axial passage of smoke and ventilating air therebetween.

The core member 20 of the filter element 14 is composed of a coherent sheet of reconstituted tobacco which, in a manner described in more detail hereinafter, is uniformly embossed with a series of parallel longitudinally extending grooves and then compacted together and bonded to itself into a self-sustaining dimensionally stable rod-like body whose longitudinal axis extends parallel to the embossed grooves. While such rod-like reconstituted tobacco body may be readily formed in any desired geometric shape, as described more fully hereinafter, it is illustrated in FIG. 4 as being circular in cross-section.

Reconstituted tobacco sheet suitable for use as a starting material in the manufacture of filter elements in accordance with the present invention, is a commercially available material made from tobacco waste products, such as the tobacco dust, fines, shorts and winnowings created during primary and secondary processing of tobacco into cigarettes, and is conventionally used in the tobacco industry primarily as a filler material which is blended in with the original natural tobacco in cigarette manufacture. Several different procedures for manufacturing reconstituted tobacco sheet are well known and commercially practiced in the art, including for example, the tobacco slurry process in which the tobacco waste particles and non-tobacco additives, if any, are suspended in water to form a thick paste which is cast and dried on a moving stainless steel belt to form a coherent reconstituted tobacco sheet. Reconstituted tobacco sheet produced by any one of these known techniques is suitable for use in the present invention.

The intermediate member 22 of the filter element 14 is formed of fibrous filtering material having a draw resistance greater than that of the reconstituted tobacco core member 20 so that smoke passing through the filter element will be directed primarily through the reconstituted tobacco member. Fibrous filtering material meeting this requirement can be readily formed by known techniques, described in greater detail hereinafter, from a continuous tow of cellulose acetate filamentary material bonded together into a self-sustaining dimensionally stable smoke-permeable body defining tortuous paths for passage of smoke therethrough. Other fibrous filtering material can also be employed, for example, fibrous filtering material formed from a filamentary tow of polyethylene, polypropylene and the like, or even from non-woven staple fibers of the type described in some detail in U.S. Pat. Nos. 3,297,041 and 3,552,400, also commonly assigned, the disclosures of which are incorporated herein by reference. However, since cellulose acetate filamentary tow is the presently preferred material from a commercial standpoint, the remainder of this specification will be directed to the use of such material for the intermediate member 22.

Figure 6:
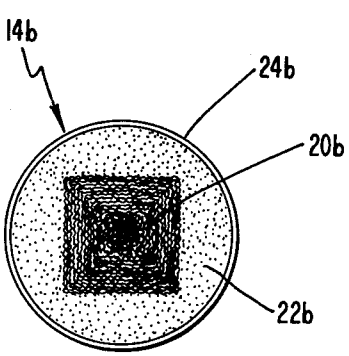
FIGS. 5 and 6 are enlarged end elevational views similar to FIG. 4, illustrating modified embodiments of the filter element according to the present invention.
Figure 5:
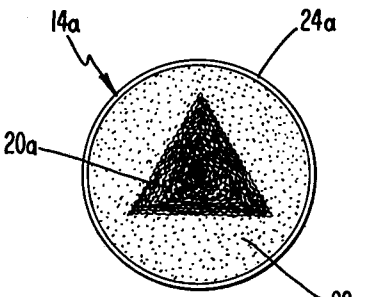

In order to offer variations in the final product from an esthetic standpoint, it is possible, in accordance with the present invention, as described in more detail hereinafter, to modify the end appearance of the filter element 14 from that illustrated in FIG. 4 by appropriate geometric shaping of the core member 20 during manufacture of the filtering element. Examples of such modifications are illustrated in FIGS. 5 and 6. Since the modified embodiments of FIGS. 5 and 6 are similar to the embodiment of FIG. 4, with the exception of the geometric shape of the core member and the contiguous inner surface of the intermediate member, similar parts are designated by the same reference numeral followed by the suffixes "a" and "b", respectively. In the modified embodiment of FIG. 5, the filter element **14*a* has a reconstituted tobacco core member 20*a* which is triangular in cross-section. In the modified embodiment of FIG. 6, the filter element 14*b* has a reconstituted tobacco core member 20*b*** which is rectangular in cross-section.

Figure 3:
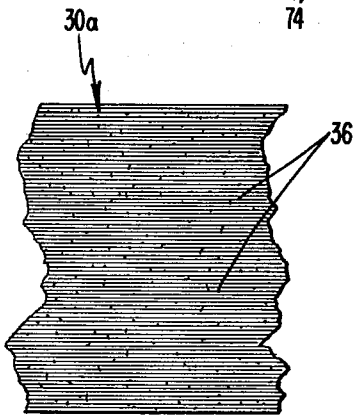
FIG. 3 is a fragmentary top view of a web of coherent reconstituted tobacco sheet used in the production of filter elements according to the present invention, after it has passed the embossing station and before it has entered the forming station of the production-line assembly shown in FIG. 2.

Reference is now made particularly to FIGS. 2, 3, 7 and 8, for the overall method and means utilized in producing filter elements in accordance with the present invention. As shown schematically in FIG. 2, a continuous web 30 of reconstituted tobacco sheet, taken from a supply roll 32, is first passed through a pair of circumferentially grooved embossing rolls 34. The embossed web **30*a* emerging from the embossing rolls 34, as illustrated in FIG. 3, has its surface uniformly embossed with a series of parallel longitudinally extending grooves 36. The embossing step effectively breaks down the sheet material in order to increase its bulk and surface area, as well as to enable it to be formed and compacted in the subsequent processing stations. The embossed web is then passed through a feed funnel 38, wherein, as will be seen in detail in FIG. 7, it becomes formed and compacted together into an axially elongated rod-like formation whose longitudinal axis extends parallel to the embossed grooves 36** on the surface of the web.

Figure 7:
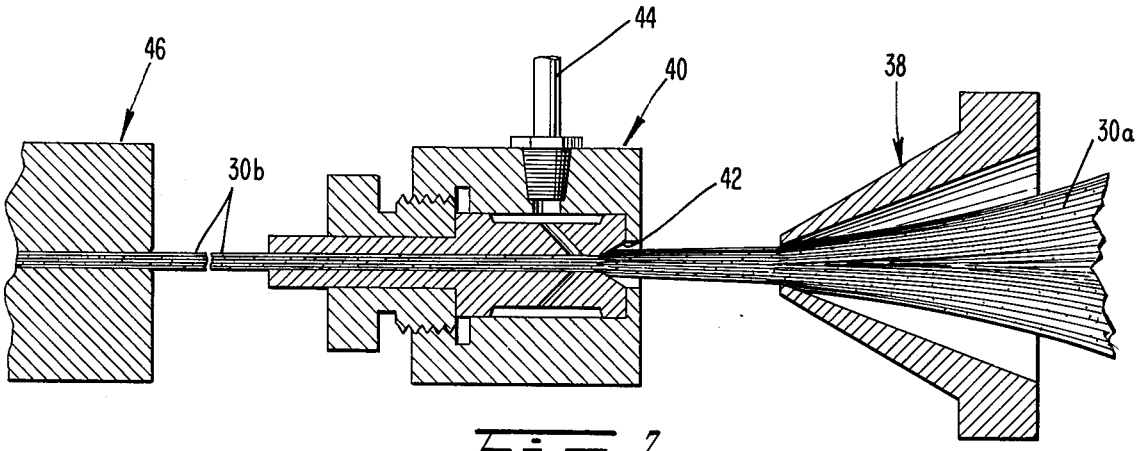
FIG. 7 is an enlarged fragmentary sectional view of a portion of the production-line assembly shown in FIG. 2, illustrating the manner in which the reconstituted tobacco core portion of the filter element is formed.

The compacted embossed web is then passed through a heat-bonding head 40, as will also be seen in detail in FIG. 7. The heat-bonding head 40 is provided with a passageway 42 extending longitudinally therethrough and a hot gas inlet 44 leading into the passageway 42 for admitting steam or other heated gas, such as air, into the passageway 42. The heat-bonding head 40 also preferably includes conventional heater elements (not shown) to maintain the block at about 400°–450° F. The hot gas inlet 44 is preferably designed so as to direct steam or heated gas, preferably at temperatures of about 500°–550° F., into the passageway 42 under pressure and at approximately a 45-degree angle with respect to the longitudinal axis of the passageway 42, whereby the heated gas travels countercurrent to the direction of movement of the web of reconstituted tobacco sheet and exits through the mouth or entrance end of the passageway 42. The passageway 42 has a cross-sectional size and shape equal to the cross-sectional size and shape desired for the reconstituted tobacco core member of the filter elements which are to be produced. As the compacted embossed web enters and passes through the passageway 42, it is subjected to heated gas treatment in the confined area defined by the passageway 42, and thereby becomes heat-bonded into a self-sustaining axially elongated rod-like reconstituted tobacco body 30*b* shaped to its desired cross-section, such as, for example, circular as in the embodiment of FIG. 4, triangular as in the embodiment of FIG. 5, or rectangular as in the embodiment of FIG. 6.

The rod-like reconstituted tobacco body 30*b* emerging from the heat-bonding head 40 is then preferably passed through a conventional air-injecting cooling head 46, wherein it is cooled by air or the like to essentially room temperature so as to enhance its dimensional stability. The reconstituted tobacco body 30*b* is thereafter passed through an elongated pulling device 48 provided with a passageway extending longitudinally therethrough and having a cross-sectional size and shape substantially equal to the cross-sectional size and shape of the reconstituted tobacco body 30*b* in order to hold it in such size and shape for a period sufficient to ensure that its dimensional stability will be maintained in the subsequent processing stations.

Figure 8:
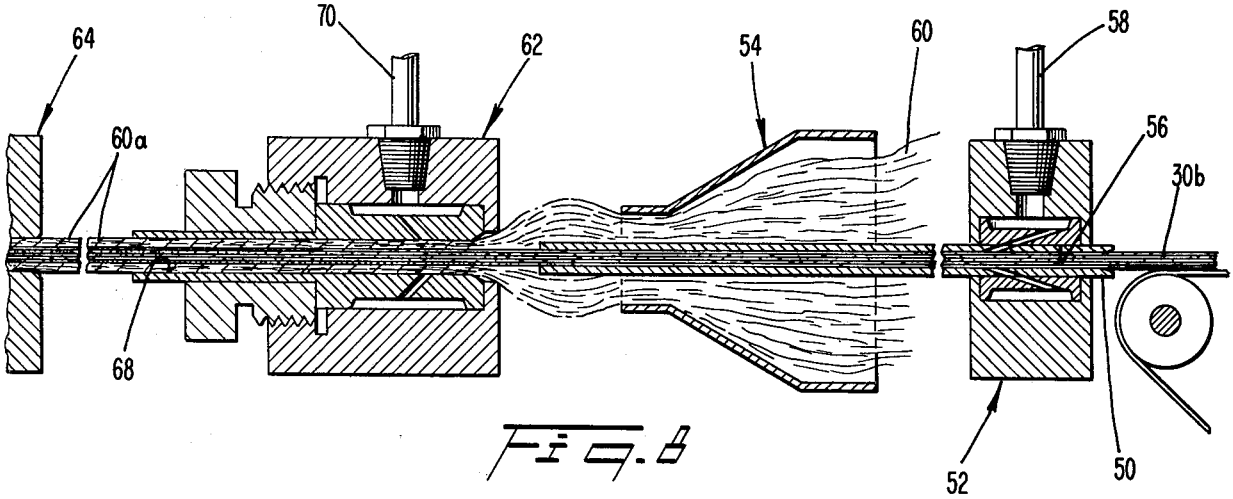
FIG. 8 is an enlarged fragmentary sectional view of another portion of the production-line assembly shown in FIG. 2, illustrating the manner in which the annular-shaped fibrous filtering material portion of the filter element is formed.

As will be seen in detail in FIG. 8, the resulting shaped and dimensionally stable self-sustaining rod-like reconstituted tobacco body 30*b*, which constitutes the core portion of the filter rod to be produced, immediately upon emerging from the pulling device 48, is then passed through a hollow tubular mandrel 50 which extends longitudinally through an air feed device 52 and a conventional stuffer jet 54. The inside cross-sectional size and shape of the mandrel 50 is sufficient to accommodate the shaped reconstituted tobacco body 30*b*. Prior to its entrance into the tubular mandrel 50, the shaped reconstituted tobacco body 30*b* may have applied thereto a line of plasticizer, e.g., triacetin, in order to ensure secure engagement between the reconstituted tobacco body and the subsequently formed fibrous filtering material body in the final filter rod, and if desired, such plasticizer can be suitably flavored to add a desired taste to the final filter elements being produced.

As will be seen in FIG. 8, the air feed device 52 is provided with a passageway 56 extending therethrough for accommodating the tubular mandrel 50, and an air inlet 58 leading into the passageway 56 and through the tubular wall of the mandrel 50 and designed to direct air under pressure into the mandrel 50 at approximately an 18-degree angle with respect to the longitudinal axis of the mandrel 50 so as to provide an air stream flowing co-current to the direction of movement of the reconstituted tobacco body 30*b* through the mandrel 50. Such air stream tends to create a suction effect at the entrance end of the mandrel 50, thereby drawing the reconstituted tobacco body into the mandrel. A continuous filamentary tow, such as cellulose acetate tow, designated generally by the reference numeral 60, which includes a multiplicity of bondable fibrous members activated by contact with a hot gas, such as steam, is continuously fed from a supply bale (not shown) into the funnel-shaped mouth or entrance of the stuffer jet 54 circumferentially around the tubular mandrel 50. As it passes through the stuffer jet 54, the filamentary tow 60 becomes formed and compacted together into an annular-like axially elongated formation around the outer surface of the tubular mandrel 50, and after emerging from the stuffer jet 54, the compacted formation of filamentary tow is fed into circumferential juxtaposition to the shaped reconstituted tobacco body 30*b* emerging from the tubular mandrel 50. The shaped reconstituted tobacco body 30*b*, together with its circumferentially enveloping shell of compacted filamentary tow, is then continuously pulled through a heat-bonding head 62 and a cooling head 64 by the garniture means 66, as shown schematically in FIG. 2. As shown in more detail in FIG. 8, the heat-bonding head 62 is similar in construction to the heat-bonding head 40, being provided with a passageway 68 extending longitudinally therethrough and a hot gas inlet 70 leading into the passageway 68 for admitting steam or other heated gas, such as air, into the passageway 68. The passageway 68 of the heat-bonding head 62 has a larger cross-sectional size than the corresponding passageway 42 of the heat-bonding head 40, sufficient to accommodate the composite rod-like body passing therethrough. As such composite body enters and passes through the passageway 68, the outer filamentary tow portion thereof is subjected to heated gas treatment in the confined area defined by the passageway 68 and thereby becomes heat-bonded into a self-sustaining hollow annular-shaped axially elongated fibrous filtering material body 60*a* circumferentially enveloping the shaped reconstituted tobacco body 30*b*, which is protected from the softening effect of the heated gas by means of the air stream flowing along its outer surface from the air feed device 52. During its passage through the conventional air-injecting cooling head 64, the fibrous filtering material body 60*a* is cooled by air, or the like, to essentially room temperature so as to enhance its dimensional stability.

After exiting from the garniture means 66, the resultant composite rod is passed through another cooling head 72 and overwrapped with a hollow cylinder of conventional air pervious plugwrap paper 74 in the garniture means 76 to form the completed filter rod, which is then severed transversely in a cutting means, such as shown schematically at 78, to form segments constituting the filter elements 14.

While the detailed description of the filter elements and their method of production in accordance with the present inventive concepts has been set forth above, in terms of their preferred embodiments, wherein the filter element 14 is composed of a rod-like core member of reconstituted tobacco, an annular-shaped intermediate member of fibrous filtering material, and an outer overwrap member of air pervious plugwrap paper, it will be understood that various modifications of such preferred embodiments may be made without departing from the spirit and scope of the present inventive concepts, the essential feature of which is the presence in the filter element of the reconstituted tobacco member in self-sustaining dimensionally stable axially elongated form. Thus, in an alternative embodiment, the fibrous filtering material member may be eliminated, and the rod-like reconstituted tobacco core member may be expanded in cross-sectional size so as to occupy the entire space within the overwrap member. In another alternative embodiment, the air pervious plugwrap paper overwrap may be eliminated, and the resulting filter element composed of the reconstituted tobacco core member within an outer shell of the annular-shaped fibrous filtering material member, can be wrapped directly with the tipping paper 16, which would result in uniform maximum air dilution without the variables that are found in porous plugwraps.

Figure 9:
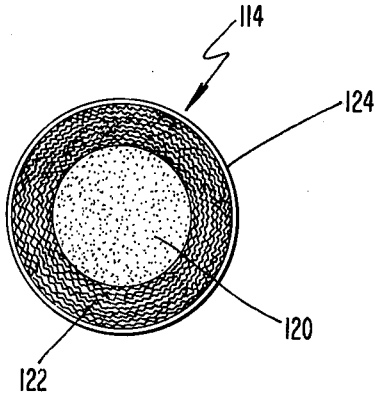
FIG. 9 is an enlarged end elevational view similar to FIG. 4, showing a modified form of the filter element in accordance with the present inventive concepts; and, FIG. 10 is a view of a further modification of a filter according to this invention.

A still further modified embodiment of filter elements in accordance with the present inventive concepts is illustrated in FIG. 9, wherein a filter element 114 has its axially elongated fibrous filtering member in the form of a rod-like core member 120, and its axially elongated reconstituted tobacco member in the form of a hollow annular-shaped intermediate member 122 circumferentially enveloping the fibrous filtering material core member 120. The reconstituted tobacco intermediate member 122, in turn, is circumferentially enveloped by an axially elongated outer overwrap member 124 consisting of a hollow cylinder of conventional air pervious plugwrap paper. Filter elements having the construction illustrated in FIG. 9 can be suitably manufactured by appropriate modifications of the manufacturing procedure described in detail above. Such modifications would include first forming a continuous rod-like body of fibrous filtering material by the conventional techique of passing a bondable continuous filamentary tow of the fibrous filtering material in rod-like formation through a heated confined area, and introducing a heated gas, such as steam, into the fibrous filtering material during its passage through the confined area, thereby bonding the fibrous filtering material into a self-sustaining dimensionally stable rod-like body. Thereafter, a continuous web of coherent reconstituted tobacco sheet, uniformly embossed with a series of parallel longitudinally extending grooves, would then be compacted together into an annular-like axially elongated formation in circumferential juxtaposition to the pre-formed rod-like body of fibrous filtering material, and the compacted embossed web, together with the fibrous filtering material body, would then be passed through a heated confined area, and a heated gas, such as steam, introduced into the compacted embossed web during its passage through the confined area, thereby bonding the compacted embossed web into a self-sustaining dimensionally stable hollow annular-shaped body circumferentially enveloping the fibrous filtering material body.

Figure 10:
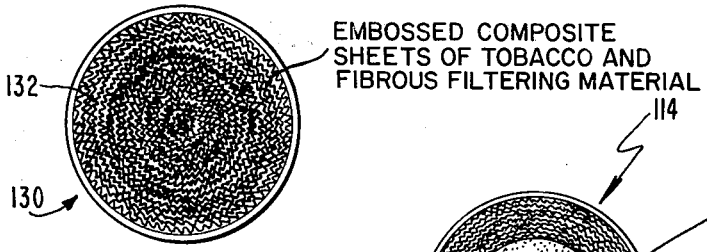

In yet another modified embodiment of filter elements in accordance with the present inventive concepts, designated generally by the reference numeral 130 in FIG. 10, the reconstituted tobacco member may take the form of a reconstituted tobacco-fibrous filtering material composite member 132 composed of a layered arrangement of at least one embossed coherent sheet of reconstituted tobacco and at least one similarly embossed coherent sheet of fibrous filtering material such as cellulose acetate, compacted and bonded together into a unitary mass. A composite member of this type may be produced in accordance with the manufacturing procedure illustrated schematically in FIG. 2, by simultaneously passing continuous webs of the two coherent sheet materials in a layered arrangement through the embossing rolls 34, feed funnel 38, heat-bonding head 40, and cooling head 46.

When the filter elements produced in accordance with the present invention are utilized as smoke filter means in conjunction with conventional air dilution in a filtered cigarette, as illustrated in FIG. 1, the mixture of smoke coming from the cigarette tobacco column 12 and ventilation air coming through the air dilution perforations 18, as it passes through the filter element 14, will be directed primarily through the reconstituted tobacco member 20, due to its lower draw resistance relative to that of the fibrous filtering material member 22. The embossed grooves 36 formed in the reconstituted tobacco member 20 provide such reconstituted tobacco member with flow passages having a high surface area for contact with the mixture of smoke and ventilation air passing therethrough, so that such mixture, while being filtered, can also extract a substantial amount of tobacco flavor from the reconstituted tobacco and thereby become significantly enriched in tobacco flavor. The reconstituted tobacco sheet employed in making the reconstituted tobacco member could be formulated with different blends of relatively strong and/or flavor-enriched tobacco so as to achieve the desired taste. In this manner, the filter elements in accordance with the present invention enable commercially acceptable taste to be obtained, even when air dilution techniques are employed together with very low tar cigarettes.

The filter elements of the present invention offer another advantage from an esthetic standpoint. With conventional cellulose acetate filters, the passage of the tobacco smoke therethrough causes a noticeable staining effect which, when air dilution is employed, is non-uniform and concentrated toward the center of the filter. With the filter elements of the present invention, on the other hand, due to the fact that the smoke is directed primarily through the reconstituted tobacco member which is dark in appearance to begin with, the staining effect of the tobacco smoke is not noticeable, and the appearance of the filter remains the same before and after smoking.

While the filter elements in accordance with the present invention have been described with particular reference to their preferred utility in conjunction with air dilution techniques, it will be understood that such filter elements also have utility in providing tobacco flavor-enriched filtered smoke in conventional filtered cigarettes which do not employ air dilution means.

The embodiments of the invention in which an exclusive property or privilege is claimed are defined as follows:

1. A smoke filter means including a filter element comprising a self-sustaining dimensionally stable axially elongated reconstituted tobacco member comprising a coherent sheet of reconstituted tobacco compacted and bonded together into a rod-like body, said reconstituted tobacco sheet being uniformly embossed with a series of parallel grooves extending longitudinally with respect to said reconstituted tobacco member so as to provide said reconstituted tobacco member with flow passages having a high surface area for contact with smoke passing therethrough and thereby enabling said smoke to become tobacco flavor-enriched by extracting tobacco flavor from the reconstituted tobacco, said reconstituted tobacco member being circumferentially enveloped by a hollow annular-shaped axially elongated member of fibrous filtering material having a draw resistance greater than that of said reconstituted tobacco member, whereby smoke passing through said filter element will be directed primarily through said reconstituted tobacco member.

2. A filtered cigarette comprising, in combination, a tobacco column and a filter means secured in end-to-end relationship to one end of said tobacco column, said filter means including a filter element as defined in claim 1.

3. A filtered cigarette according to claim 2, wherein said filter means is secured to said one end of said tobacco column by means of a hollow cylinder of tipping paper having a plurality of perforations communicating the surrounding air with said reconstituted tobacco member, whereby for a given draw, a tobacco flavor-enriched mixture of smoke and ventilation air enters the smoker's mouth.

4. A filter rod comprising a multiplicity of filter elements as defined in claim 1, integrally connected together in end-to-end relationship to each other.

5. A filter element according to claim 1, further comprising an outer overwrap member consisting of a hollow cylinder of air pervious plugwrap paper.

6. A filter element according to claim 1, wherein said fibrous filtering material is cellulose acetate tow.

7. A filter element according to claim 1, wherein said reconstituted tobacco member is circular in cross-section.

8. A filter element according to claim 1, wherein said reconstituted tobacco member is triangular in cross-section.

9. A filter element according to claim 1, wherein said reconstituted tobacco member is rectangular in cross-section.

10. A filter element according to claim 1, wherein said annular-shaped axially elongated member is circumferentially enveloped by a hollow cylinder of air pervious plugwrap paper.

11. A smoke filter means including a filter element comprising a self-sustaining dimensionally stable axially elongated reconstituted tobacco member comprising a coherent sheet of reconstituted tobacco compacted and bonded together, said reconstituted tobacco sheet being uniformly embossed with a series of parallel grooves extending longitudinally with respect to said reconstituted tobacco member so as to provide said reconstituted tobacco member with flow passages having a high surface area for contact with smoke passing therethrough and thereby enabling said smoke to become tobacco flavor-enriched by extracting tobacco flavor from the reconstituted tobacco, said reconstituted tobacco member being in the form of a hollow annular-shaped body circumferentially enveloping a rod-like core member of fibrous filtering material having a draw resistance greater than that of said reconstituted tobacco member, whereby smoke passing through said filter element will be directed primarily through said reconstituted tobacco member.

12. A filter element according to claim 11, wherein said fibrous filtering material is cellulose acetate tow.

13. A filter element according to claim 11, wherein said reconstituted tobacco member is circumferentially enveloped by a hollow cylinder of air pervious plugwrap paper.

14. A smoke filter means including a filter element comprising a self-sustaining dimensionally stable axially elongated reconstituted tobacco member comprising a coherent sheet of reconstituted tobacco compacted and bonded together, said reconstituted tobacco sheet being uniformly embossed with a series of parallel grooves extending longitudinally with respect to said reconstituted tobacco member so as to provide said reconstituted tobacco member with flow passages having a high surface area for contact with smoke passing therethrough and thereby enabling said smoke to become tobacco flavor-enriched by extracting tobacco flavor from the reconstituted tobacco, said reconstituted tobacco member being in the form of a reconstituted tobacco-fibrous filtering material composite member composed of a layered arrangement of at least one of said embossed coherent sheets of reconstituted tobacco and at least one similarly embossed coherent sheet of fibrous filtering material compacted and bonded together into a unitary mass.

* * * * *